US008763438B2

(12) United States Patent
Sato et al.

(10) Patent No.: US 8,763,438 B2
(45) Date of Patent: Jul. 1, 2014

(54) WORKING APPARATUS AND WORKING METHOD OF SHEET METAL

(75) Inventors: Koichi Sato, Tokyo (JP); Masaaki Mizumura, Tokyo (JP); Tohru Yoshida, Tokyo (JP); Eiji Isogai, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 91 days.

(21) Appl. No.: 13/138,571

(22) PCT Filed: Mar. 3, 2010

(86) PCT No.: PCT/JP2010/053935

§ 371 (c)(1),
(2), (4) Date: Sep. 1, 2011

(87) PCT Pub. No.: WO2010/101295

PCT Pub. Date: Sep. 10, 2010

(65) Prior Publication Data

US 2011/0314886 A1 Dec. 29, 2011

(30) Foreign Application Priority Data

Mar. 4, 2009 (JP) ..... 2009-050144

(51) Int. Cl.
*B21D 5/08* (2006.01)
*B21D 7/022* (2006.01)

(52) U.S. Cl.
USPC ..... 72/176; 72/214

(58) Field of Classification Search
USPC ..... 72/127, 170, 171, 172, 174, 176, 177, 72/178, 252.5, 367.1, 160, 181, 182, 214, 72/220
See application file for complete search history.

(56) References Cited

U.S. PATENT DOCUMENTS

| | | | | |
|---|---|---|---|---|
| 2,574,509 | A * | 11/1951 | Stuart | 72/177 |
| 5,224,253 | A * | 7/1993 | Sawa | 72/220 |
| 2008/0250835 | A1 | 10/2008 | Hasegawa et al. | |

FOREIGN PATENT DOCUMENTS

| | | |
|---|---|---|
| JP | 52-008971 | 1/1977 |
| JP | 62-134119 | 6/1987 |
| JP | 63-005825 | 1/1988 |
| JP | 64-031527 | 2/1989 |
| JP | 04-210823 | 7/1992 |
| JP | 06-154925 | 6/1994 |
| JP | 08-197161 | 8/1996 |
| JP | 11-285750 | 10/1999 |
| JP | 2004-174531 | 6/2004 |
| JP | 2005-169496 | 6/2005 |
| JP | 2005-349471 | 12/2005 |
| JP | 2007-216258 | 8/2007 |
| JP | 2008-012559 | 1/2008 |

OTHER PUBLICATIONS

International Search Report dated Jun. 22, 2010 issued in corresponding PCT Application No. PCT/JP2010/053935.

* cited by examiner

*Primary Examiner* — Teresa M Ekiert
(74) *Attorney, Agent, or Firm* — Kenyon & Kenyon LLP

(57) ABSTRACT

The present invention has its object to provide an efficient, general use shaping technique for forming high strength sheet metal into a three-dimensionally complicated shape. Further, the present invention provides a working apparatus for shaping sheet metal comprising a die (also called a "punch") which has a shape suitable for a shape of shaped sheet metal, a plurality of rolls which grip sheet metal (H) with the die to shape the sheet metal, roll movement mechanisms which makes the rolls independently move in a horizontal direction and make them independently ascend or descend in a vertical direction, and a roll angle setting mechanism which can change an angle by which the rolls are pressed against the die.

14 Claims, 11 Drawing Sheets

WORKING APPARATUS AND WORKING METHOD OF SHEET METAL

This application is a national stage application of International Application No. PCT/JP2010/053935, filed Mar. 3, 2010, which claims priority to Japanese Patent Application No. 2009-050144, filed Mar. 4, 2009, the content of which is incorporated herein by reference.

TECHNICAL FIELD

The present invention relates to a working apparatus for shaping sheet metal and a working method using that working apparatus.

BACKGROUND ART

In recent years, for example, in the fields of auto parts, building material parts, furniture parts, etc., high strength sheet metal has been used for realizing lighter weight while securing rigidity. Such sheet metal has been shaped in the past by, for example, press forming or roll forming, but the drop in formability accompanying the increase in strength of the sheet metal is making it difficult to form such sheet metal into complicated shapes.

For example, when using press forming, a flange part of the shaped sheet metal upon which a tensile force acts sometimes becomes cracked at that flange part, or the flange part of the sheet metal upon which a compressive force acts sometimes becomes wrinkled at that flange part.

Further, when using roll forming, it is possible to form a sheet metal to a single simple cross-sectional shape in the longitudinal direction, but forming sheet metal into a complicated shape where the cross-section changes in the longitudinal direction is difficult.

On the other hand, it has been proposed to combine press forming and roll forming so as to shape sheet metal. For example, in PLT 1, there is provided a press apparatus for forming splines or other gearwheel shapes at the outer circumferential surface by roll forming which has a die at the outer circumferential surface of which the sheet metal to be worked is loaded, a die ring arranged concentrically with the die, and a plurality of forming rolls which are arranged radially at the inner circumference of the die ring and which rotate while being gripped between the sheet metal and the inner circumferential surface of the die ring. Further, the die ring is made to move relative to the die and the plurality of forming rolls are made to rotate so as to shape the sheet metal.

PLT 2 discloses a roll forming method in a roll forming apparatus which forms a long object like a frame part into a curved shape, wherein the forming rolls are made to move on a translation cam matching the shape of the long object and wherein the forming rolls are made to ascend or descend so as to follow the shape of the translation cam and thereby work the object into a shape curved in the longitudinal direction.

PLT 3 discloses a roll forming method which joins together perpendicularly intersecting sheet metal (seaming) during which folding back the sheet metal at the seam part (hemming) and forming the seam part at that time by placing a forming roll having a right angled cross-section against the right angle seam part of the sheet metal and rotating it while pressing.

CITATION LIST

Patent Literature

PLT 1: Japanese Patent Publication (A) No. 6-154925
PLT 2: Japanese Patent Publication (A) No. 64-31527
PLT 3: Japanese Patent Publication (A) No. 8-197161

SUMMARY OF INVENTION

Technical Problem

However, in the art described in PLT 1, while the sheet metal can be formed into a gearwheel shape (wavy shape), the cross-section in the longitudinal direction becomes the same shape. That is, it is not possible to form sheet metal into a complicated shape such as one where the cross-section changes in the longitudinal direction. Further, it is also not possible to form sheet metal so that its height changes in the longitudinal direction. Therefore, it is not possible to form sheet metal to a three-dimensionally complicated shape.

The art described in PLT 2 also can be applied to the case of working a material having a cross-section in the longitudinal direction of the same shape and furthermore curved in a direction perpendicular to the longitudinal direction, but it is not possible to form the sheet metal into a complicated shape with a cross-section which changes in the longitudinal direction.

In the art described in PLT 3 as well, it is possible to work a material to give a fixed shape at the shoulder parts, but it is not possible to form sheet metal to a complicated cross-section or a complicated shape of a changing cross-section.

Further, what these prior arts have in common, it may be said, is that they are mere extensions of the conventional roll forming method, so are not suitable for working sheet metal having a high strength such as high strength steel. A working technique which is efficient and is high in general applicability is being sought for meeting the future rising demand for working high strength sheet metal into any shapes.

The present invention was made in consideration of the problem that with the conventional roll forming technique, there are limits to the work and that forming a material so as to produce a complicated cross-section or a complicated shape of a changing cross-section is not possible and in consideration of the demand for an efficient method of working high strength sheet metal. That is, the problem to be solved by the present invention is the provision of an efficient, general use forming technique for forming high strength sheet metal into a three-dimensionally complicated shape. Here, "forming into a complicated shape" includes, for example, in a cross-sectional hat-shaped part, working it so that the width of a hat part changes, the width of a flange part changes, or an elongated flange part and a compressed flange part both exist. Of course, forming a three-dimensional complicated shape for which a desired shape of the final product is difficult to obtain by simple press forming due to the mixture of compressed parts and elongated parts is also included.

Solution to Problem

The inventors engaged in in-depth studies to solve this problem and as a result discovered that by combining press forming, which enables efficient working of high strength sheet metal, and roll forming, which is suitable for working complicated shapes, and pressing a roll against a press die to work the sheet metal, even high strength sheet metal can be optimally worked to any shape and thereby completed the present invention.

That is, the present invention provides a working apparatus for shaping sheet metal comprising a die (also called a "punch") which has a shape suitable for a shape of the shaped sheet metal, a plurality of rolls which grip sheet metal with the die to shape the sheet metal, roll movement mechanisms which make the rolls independently move in a horizontal direction and make them independently ascend or descend in a vertical direction, and a roll angle setting mechanism which can change an angle by which the rolls are pressed against the die.

According to the present invention, the rolls can be moved along the ridge lines of the die in the horizontal direction independently, so even if the cross-section of the shaped sheet metal changes in the longitudinal direction, it is possible to make the rolls move while tracking the changes in the cross-section. Further, the rolls can be made to ascend and descend in the vertical direction independently, so even if the shaped sheet metal changes in height, it is possible to make the rolls ascend and descend while tracking the changes in height and have the rolls and corresponding working surface of the die grip the sheet metal by a predetermined load. In this way, the rolls can be independently made to move three-dimensionally, so it is possible to form the sheet metal into a three-dimensionally complicated shape.

Further, it is possible to provide a roll angle setting mechanism which can adjust the angle by which the rolls are pressed against the die and to handle the operation for forming any complicated shape by joint operation with the three-dimensional movement mechanisms.

Furthermore, the rolls can be respectively given load detection devices. These load detection devices can be used to control the working load at the time of shaping so as to shape the material.

In addition, the die may also move up and down while shaping the material.

Note that, a "three-dimensionally complicated shape" includes the shape of a part with a width changed in any way.

Each of the rolls may have a main roll part and a projecting roll part which projects out concentrically from the main roll part and has a diameter smaller than the main roll part.

An outer circumferential surface of a corner part of a main roll part and a projecting roll part may be provided with, over its entirety, a curved part which is curved to project outward to an inside in a side view, and the plurality of rolls may have rolls provided with curved parts with different radii of curvature.

Note that, a "corner part" means a part formed by a surface of a main roll part and an outer circumferential surface of a projecting roll part.

The plurality of rolls may have rolls which are provided with projecting roll parts with different diameters.

The bottom surface of the die may have a shape with an inside which projects out compared with the outer sides, while the projecting roll parts may project out to the inside compared with the main roll parts. Further, the bottom surface of the die may have a shape with outer sides which project out further compared with an inside, while the projecting roll parts may project out to the outer sides compared with the main roll parts.

Another aspect of the present invention is a working method using a die and a plurality of rolls to shape sheet metal characterized in that the rolls ascend independently in a vertical direction and in that the rolls and the die grip sheet metal between them by a predetermined load while the die shapes the sheet metal.

Further, the rolls may be moved along ridge lines of the die independently.

Furthermore, the rolls may not only ascend or descend in the vertical direction, but also move in the horizontal direction and may grip and shape the sheet metal at any position by a predetermined load.

At that time, the rolls may be set by the working roll angle setting mechanism to any angle for pressing against the die for shaping the material.

It is also possible to use the plurality of rolls moving back-and-forth (reciprocal motion) horizontally along a ridge line of a bottom face of the die so as to shape the sheet metal.

Each of the rolls may have a main roll part, a projecting roll part which projects out from the main roll part and which has a smaller diameter than the main roll part, and a curved part which is provided over an entirety of an outer circumferential surface of a corner part of the main roll part and the projecting roll part and which is curved to project to an inside in a side view. It is possible to use a plurality of rolls with different radii of curvature of curved parts to shape the sheet metal.

It is also possible to use a plurality of rolls with different diameters of the projecting roll parts to shape the sheet metal.

The shaped sheet metal may have an elongated flange part and a compressed flange part.

At that time, at an elongated flange part where a tensile force acts on the shaped sheet metal, a pair of the rolls may be moved in a direction approaching each other centered about the elongated flange part to thereby shape the elongated flange part. Further, at a compressed flange part where a compressive force acts on the shaped sheet metal, a pair of the rolls may be moved in a direction separating from each other centered about the compressed flange part to thereby shape the compressed flange part.

Of course, the sheet metal may also be high strength steel which has a 780 MPa or higher tensile strength. Furthermore, among tensile strength 980 MPa or higher ultra high strength steels as well, it may be 1470 MPa or higher ultra high strength steel.

Advantageous Effects of Invention

According to the present invention, it is possible to efficiently form high strength sheet metal into a three-dimensionally complicated shape.

DESCRIPTION OF EMBODIMENTS

Figure 1:
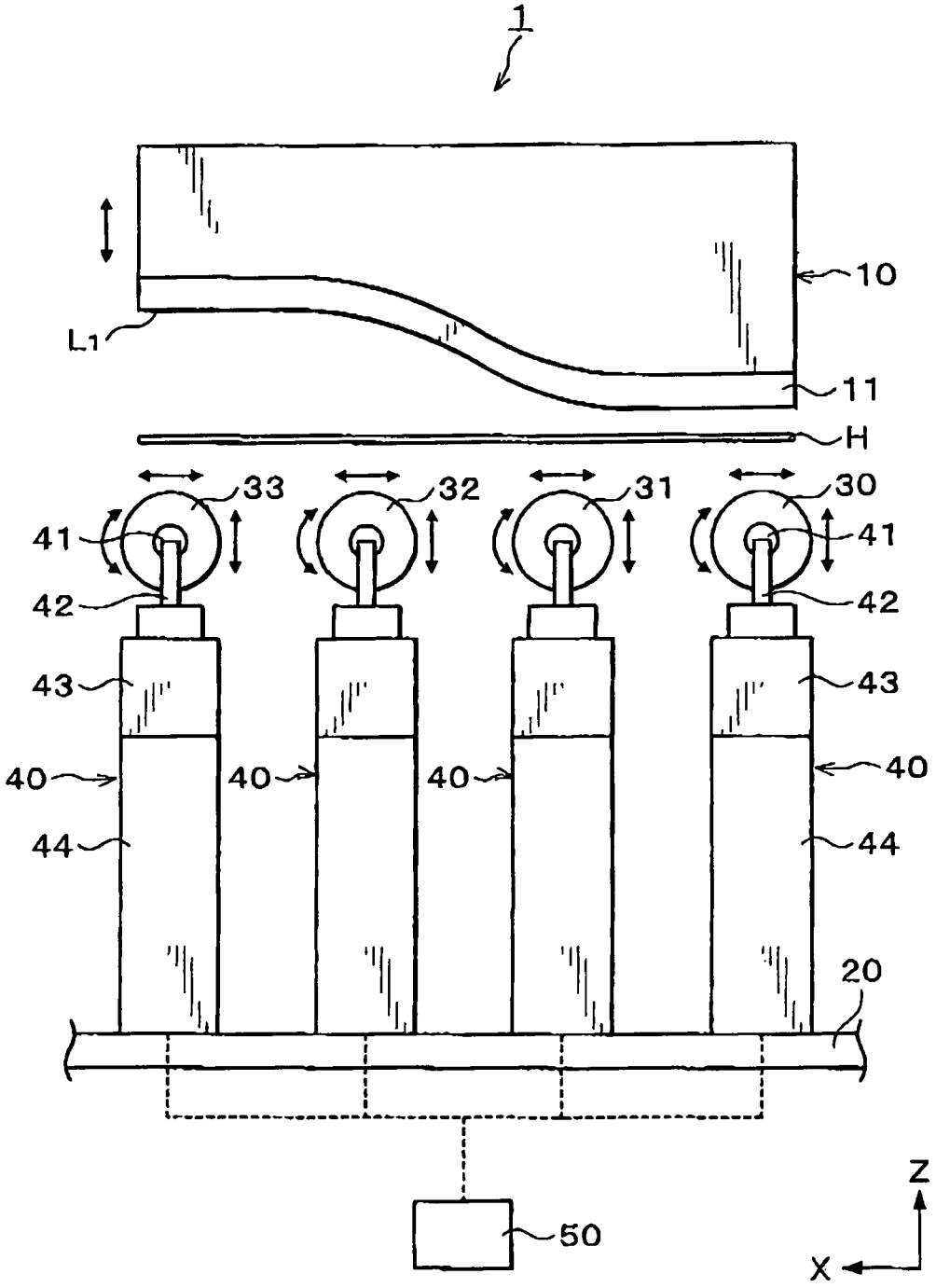
FIG. 1 is a side view showing an outline of the configuration of a working apparatus according to the present embodiment.
Figure 2:
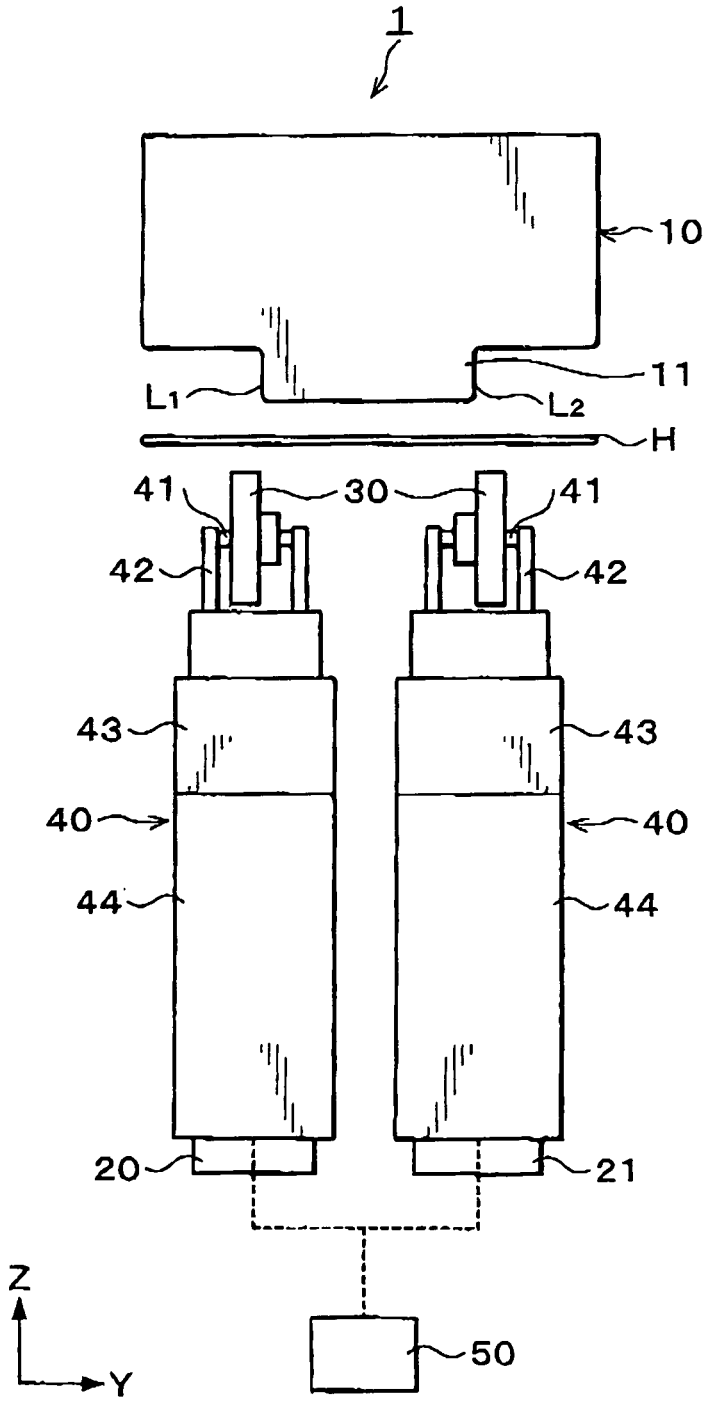
FIG. 2 is a side view showing an outline of the configuration of a working apparatus according to the present embodiment.
Figure 3:
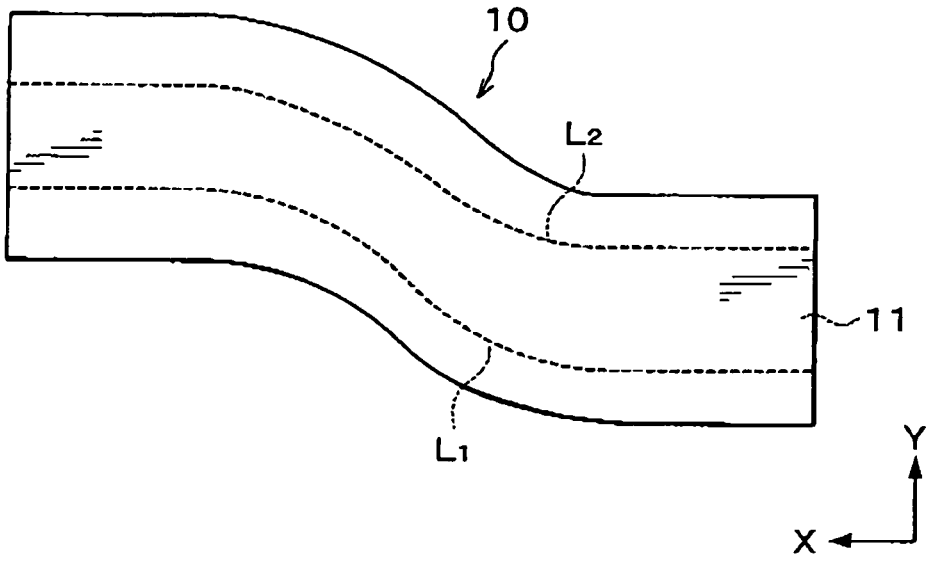
FIG. 3 is a plan view showing an outline of a die of a working apparatus according to the present embodiment.

Below, an embodiment of the present invention will be explained. FIG. 1 and FIG. 2 are side views showing the outline of the configuration of a working apparatus 1 for shaping flat sheet metal H according to this embodiment. Further, FIG. 3 is a plan view showing the outline of the configuration of the working apparatus 1.

Figure 5:
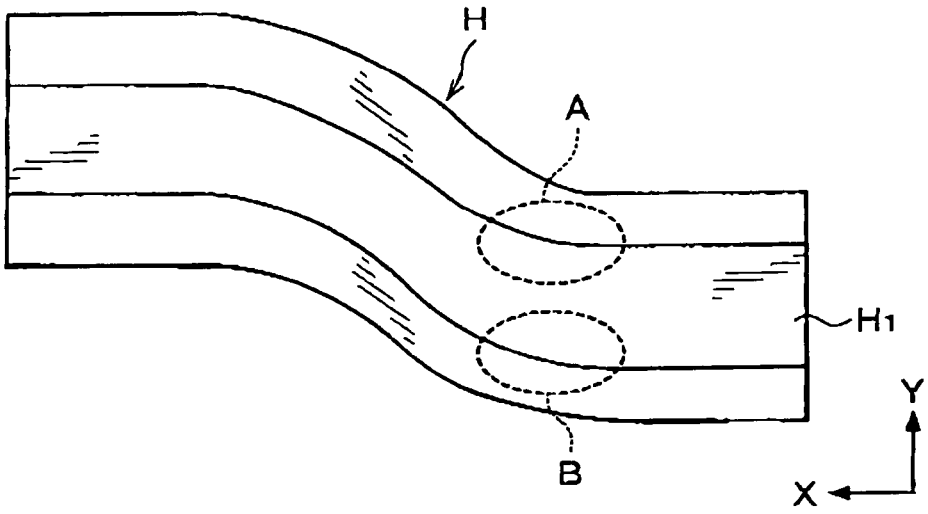
FIG. 5 is a plan view of shaped sheet metal.
Figure 6:
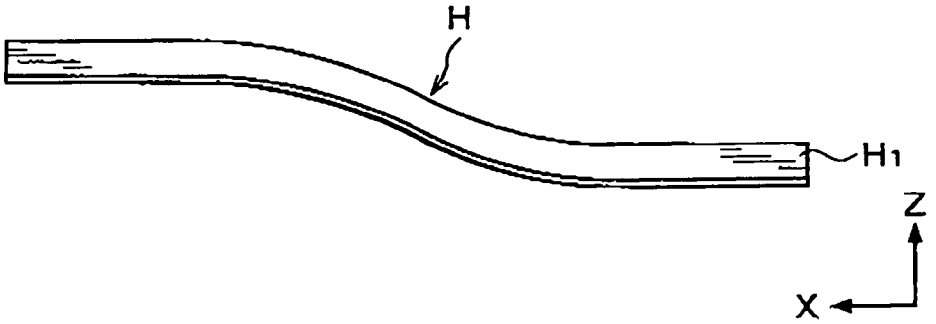
FIG. 6 is a side view of shaped sheet metal.
Figure 7:
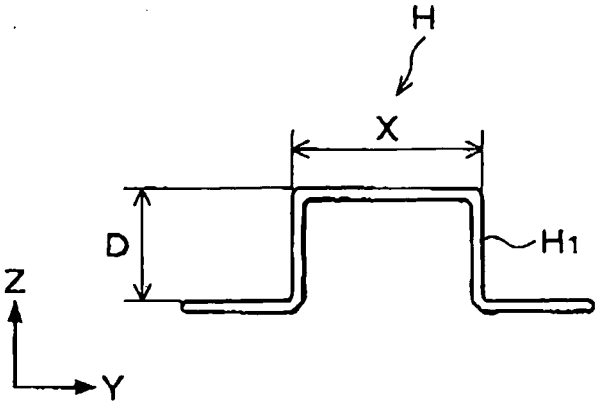
FIG. 7 is a side view of shaped sheet metal.

In the present embodiment, the working apparatus 1 is used to work sheet metal H so that, as shown in FIG. 5 to FIG. 7, its inside projects outward. The sheet metal H, as shown in FIG. 5, has a snaking shape in the plan view. Further, the shaped sheet metal H, as shown in FIG. 6, has a height which changes along the longitudinal direction (X-direction of FIG. 6) of the sheet metal H. The projecting part H1 of the shaped sheet metal H, as shown in FIG. 7, has a substantially square shape. This projecting part H1 is continuously formed along the longitudinal direction of the sheet metal H and changes in size. That is, the height D (Z-direction of FIG. 7) and width W (Y-direction of FIG. 7) of the projecting part H1 change in the longitudinal direction of the sheet metal H in the shape.

The working apparatus 1, as shown in FIG. 1, has a die 10 (also called a "punch"). The die 10 has a shape of the bottom surface suitable for the shape of the steel sheet H shaping. That is, the die 10, as shown in FIG. 3, has a snaking shape in the plan view. Further, the bottom surface of the die 10, as shown in FIG. 1, has a height which changes along the longitudinal direction of the die (X-direction of FIG. 1). Furthermore, at the inside of the bottom surface of the die 10, as shown in FIG. 2 and FIG. 3, a projecting part 11 which projects out compared with the outer sides is formed along the longitudinal direction of the die 10 (X-direction of FIG. 3).

Figure 4:
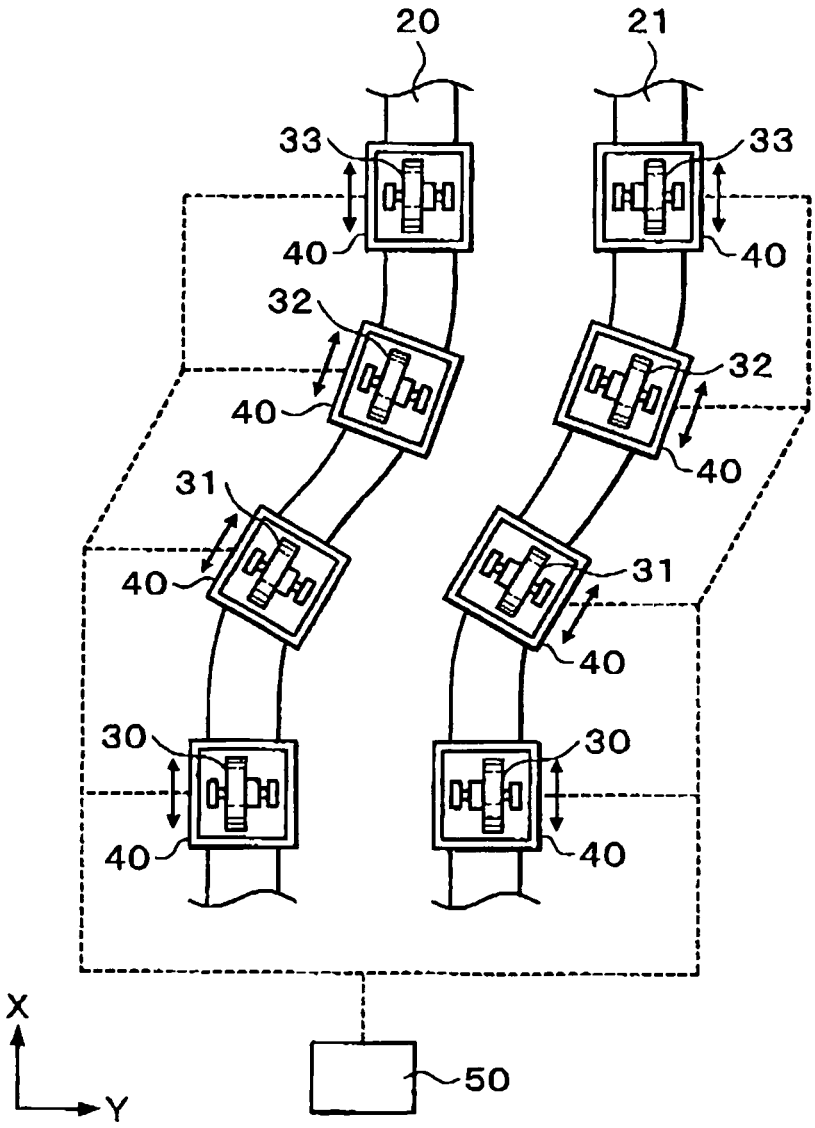
FIG. 4 is a plan view showing an outline of the configuration of a working apparatus according to the present embodiment.

Below the die 10, as shown in FIG. 4, two rails 20 and 21 are provided. The rails 20 and 21 are laid along ridge lines L1 and L2 of the projecting part 11 of the die 10 shown in FIG. 3.

On the rail 20, as shown in FIG. 1 and FIG. 4, a plurality of, for example, four, types of rolls 30 to 33 are arranged. Further, on the rail 21 as well, similarly, rolls 30 to 33 are arranged. That is, the working apparatus 1 is provided with a total of eight rolls 30 to 33. The rolls 30 to 33 are respectively provided with roll movement mechanisms 40 which support the rolls 30 to 33 and can move on the rails 21 and 21 in the horizontal direction independently. The roll movement mechanisms 40, as explained later, can make the rolls 30 to 33 ascend and descend in the vertical direction independently.

Figure 8:
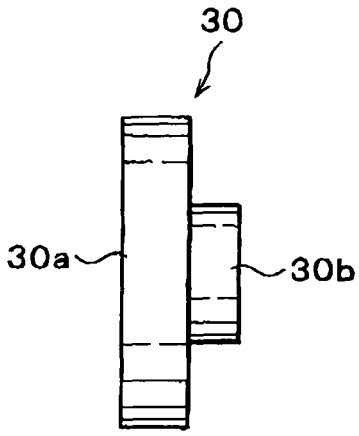
FIG. 8 is a side view of a roll.

Each of the rolls 30, as shown in FIG. 8, has a main roll part 30*a* and a projecting roll part 30*b* which projects out from the main roll part 30*a* concentrically and has a smaller diameter than the main roll part 30*a*. The rolls 30, as shown in FIG. 2, are arranged below the ridge lines L1 and L2 of the projecting part 11 of the die 10. Further, the rolls 30, so as to match the shape of the projecting part 11, have the main roll parts 30*a* arranged at the outer sides of the projecting part 11 and have the projecting roll parts 30*b* arranged below the projecting part 11. That is, the rolls 30 are arranged on the rails 20 and 21 so that the projecting roll parts 30*b* project out to the inside. Note that, the rolls 31 to 33 also have similarly configured main roll parts 31*a* to 33*a* and projecting roll parts 31*b* to 33*b* and are similarly arranged on the rails 20 and 21.

The roll movement mechanisms 40, as shown in FIG. 1 and FIG. 2, have shafts 41 which run through the centers of the rolls 30 to support them. The shafts 41 are supported through support members 42 at cylinders 43. For the cylinders 43, for example, hydraulic type cylinders are used. The cylinders 43 enable the rolls 30 to ascend or descend in the vertical direction. Further, by the rolls 30 ascending or descending, the rolls 30 and the bottom surface of the die 10 can grip the sheet metal H and shape it. At the bottom surfaces of the cylinders 43, for example, drive mechanisms 44 with built-in motors (not shown) etc. are provided. The drive mechanisms can be used to make the rolls 30 move on the rails 20 and 21 in the horizontal direction. Note that, FIG. 2 explained the roll movement mechanisms 40 of the rolls 30, but the roll movement mechanisms 40 of the other rolls 31 to 33 are also similarly configured.

The cylinders 43 and drive mechanisms 44 of the roll movement mechanisms 40, as shown in FIG. 1 and FIG. 4, are controlled by a control unit 50. The control unit 50 controls the cylinders 43 to control the vertical load when the rolls 30 to 33 and die 10 grip the sheet metal H to a predetermined load. The vertical load can be measured by conversion of the inputs to the cylinders 43 (for example, if hydraulic cylinders, the amounts of hydraulic fluid). Further, for example, it is also possible to set load measuring devices (not shown) between the cylinders 43 and the drive mechanisms 44 and use these to measure the load.

Further, the control unit 50 controls the drive mechanisms 44 to control the movement of the rolls 30 to 33 in the horizontal direction, for example, the movement directions, movement speeds, numbers of times of reciprocating motion, etc. The predetermined load when gripping the sheet metal H and the movement of the rolls 30 to 33 in the horizontal direction are set by the material, thickness, or formed shape of the sheet metal H. Note that, depending on the set conditions, reciprocating motion of the rolls 30 to 33 in the horizontal direction is not necessary—a single movement is enough to shape the sheet metal H.

Above, an aspect where the drive mechanisms move on rails 20 and 21 and therefore the rolls also respectively move independently was explained. However, with this aspect, movement is possible only in the range where the rails are arranged, but there is no need to be bound by this. Various aspects may be considered.

For example, any drive mechanisms 44 which enable movement to any position on a horizontal platen (not shown) can make the individual rolls independently move to any positions. These also enable the rolls to be moved up and down in the vertical direction through the cylinders 43 and support members 42, so as a result the rolls can also be independently arranged at any position in a three-dimensional space. In this way, the movement mechanisms are not limited to this aspect. Any ones which enable the rolls to be arranged in a three-dimensional space falls under the technical scope of the present invention.

Further, in the above aspect, the angles by which the rolls 30 are attached to the roll movement mechanisms 40 are fixed, but, for example, in FIG. 2, mechanisms (not shown) may be provided by which the shafts 41 supporting the rolls 30 can rotate about the Z-axis (in some cases, the Y-axis as well). Furthermore, mechanisms (not shown) may be provided by which they rotate about the X-axis (direction vertical to paper surface). These rotational mechanisms enable the angles by which the rolls 30 are pressed against the die 10 to be set to any angles. These rotational mechanisms will be referred to all together in the present invention as the "roll angle setting mechanisms".

Whatever the aspect, the working load acts as a reaction force on the rails 20 and 21 or horizontal platen (not shown) or other support members of the drive mechanisms 40. The support members are simple shapes, so can be easily given rigidity for withstanding the working reaction force. By designing the rigidity of the apparatus as a whole in accordance with the metal material being worked, it is possible to easily design an apparatus able to handle even materials requiring a large working load such as high strength steel or ultra high strength steel or ultra ultra high strength steel.

Next, the method of using the working apparatus 1 configured as shown in FIG. 1 so as to work the sheet metal H will be explained.

Figure 9:
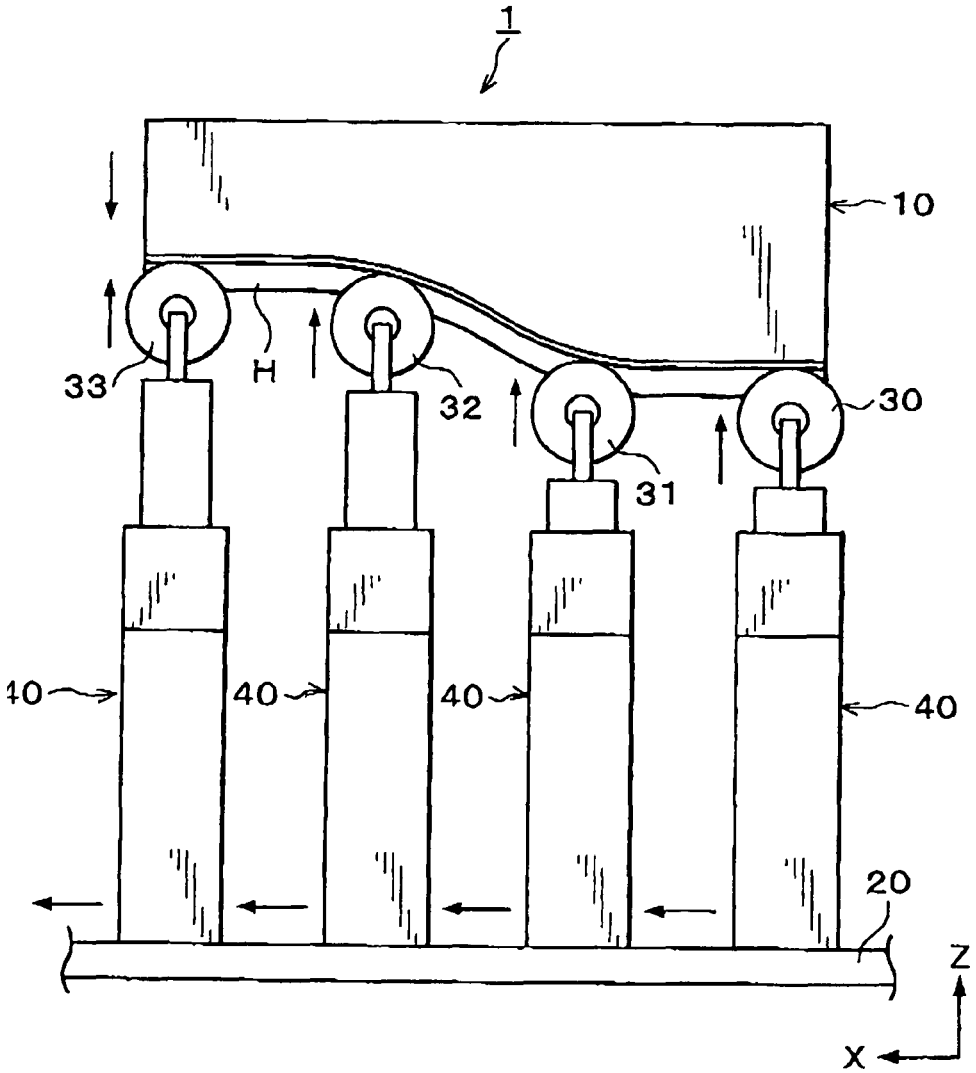
FIG. 9 is an explanatory view showing the state of the working apparatus shaping sheet metal.

First, as shown in FIG. 9, the die 10 is made to descend and the rolls 30 to 33 are made to independently ascend so that the bottom surface of the die 10 and the rolls 30 to 33 grip the sheet metal H. Further, while gripping the sheet metal H, the rolls 30 to 33 are independently made to move back and forth over the rails 20 and 21. At this time, the control unit 50 controls the cylinders 43 so that the vertical load which is applied to the sheet metal H constantly becomes a predetermined value. Further, the control unit 50 controls the drive mechanisms 44 so that the movement directions, movement speeds, numbers of reciprocating motions, etc. of the rolls 30 to 33 become predetermined values. In this way, the sheet metal H is worked into a predetermined shape.

According to the above embodiment, the rolls 30 to 33 can be moved by the drive mechanisms 44 along the ridge lines L1 and L2 of the bottom surface of the die 10 in the horizontal direction independently, so even if the cross-sectional shape of the shaped sheet metal H changes, the change in the cross-sectional shape can be tracked and the rolls 30 to 33 made to move. Further, the rolls 30 to 33 can be made to ascend/descend by the cylinders 43 in the vertical direction independently, so even if the shaped sheet metal H changes in height, it is possible to track the changes in height and make the rolls 30 to 33 ascend/descend so as to have the rolls and the bottom surface of the die grip the sheet metal between them by a predetermined load. Since the rolls 30 to 33 can be made to independently move in three dimensions in this way, the sheet metal H can be worked to a three-dimensionally complicated predetermined shape.

Further, the cylinders 43 and the drive mechanisms 44 are controlled by the control unit 50, so the bottom surface of the die 10 and the rolls 30 to 33 can grip the sheet metal H between them constantly by a predetermined load. For this reason, it is possible to form the sheet metal H precisely to a predetermined shape.

Figure 10:
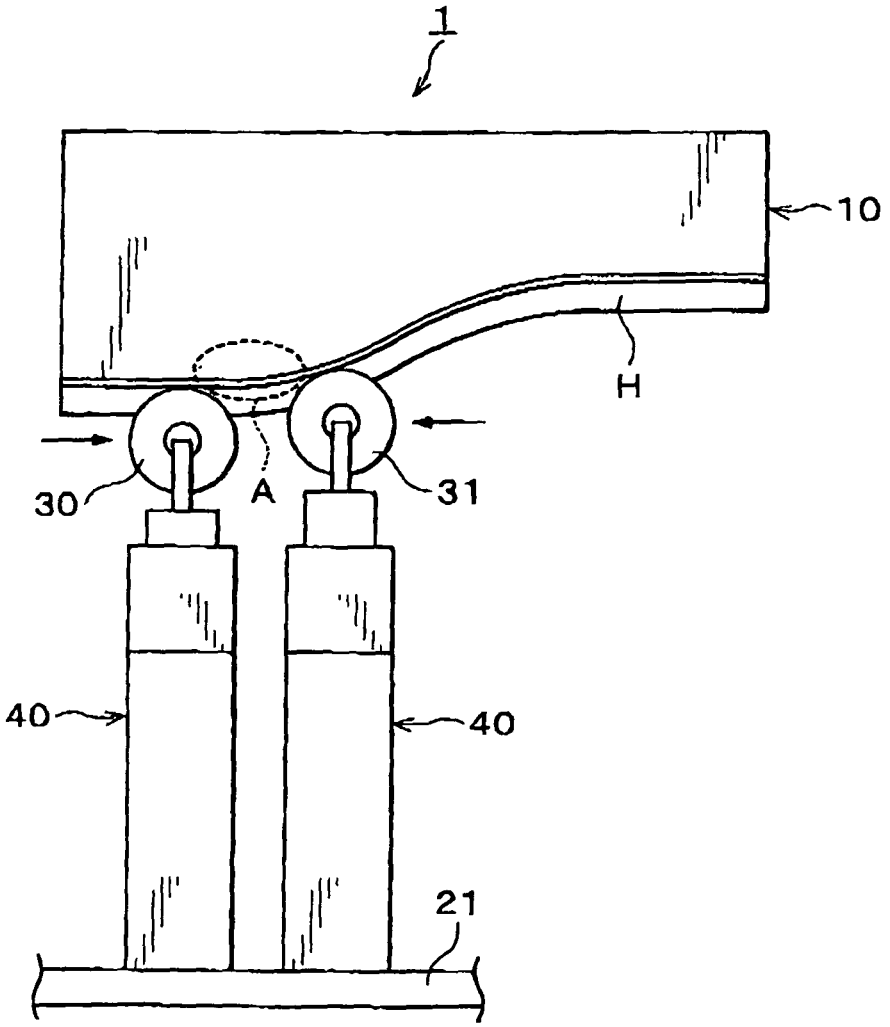
FIG. 10 is an explanatory view showing the state of the working apparatus shaping sheet metal.

In this regard, as shown in FIG. 5, when shaping the sheet metal H, for example, sometimes the part A of the shaped sheet metal H on which the tensile force acts (hereinafter referred to as "elongated flange part A") is cracked at the sheet metal H. Therefore, when using the working apparatus 1 to shaping the sheet metal H, as shown in FIG. 10, it is also possible to make a pair of adjoining rolls 30, 31 move in a direction approaching each other centered about the elongated flange part A so as to shape the elongated flange part A. In this case, due to the rolls 30 and 31, the tensile force on the elongated flange part A is eased, so it is possible to prevent wrinkling of the sheet metal H at the shaped elongated flange part A.

Figure 11:
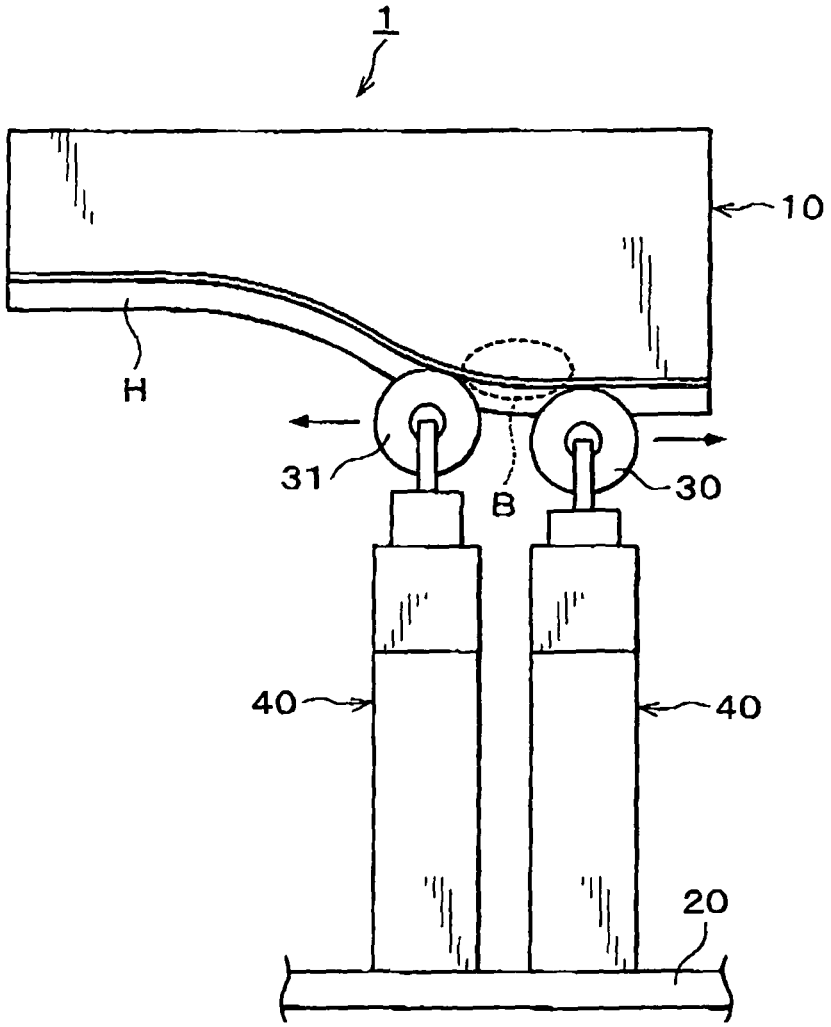
FIG. 11 is an explanatory view showing the state of the working apparatus shaping sheet metal.

Further, as shown in FIG. 5, when shaping the sheet metal H, for example, the part B of the shaped sheet metal H on which a compressive force acts (hereinafter referred to as the "compressed flange part B") is sometimes wrinkled at the sheet metal H. Therefore, when using the working apparatus 1 to shape the sheet metal H, as shown in FIG. 11, the pair of adjoining rolls 30, 31 are made to move in directions away from each other centered about the compressed flange part B so as to shape the compressed flange part B. In this case, due to the rolls 30 and 31, the compressive force on the compressed flange part B is eased, so it is possible to prevent wrinkling of the sheet metal H at the shaped compressed flange part B.

Figure 12:
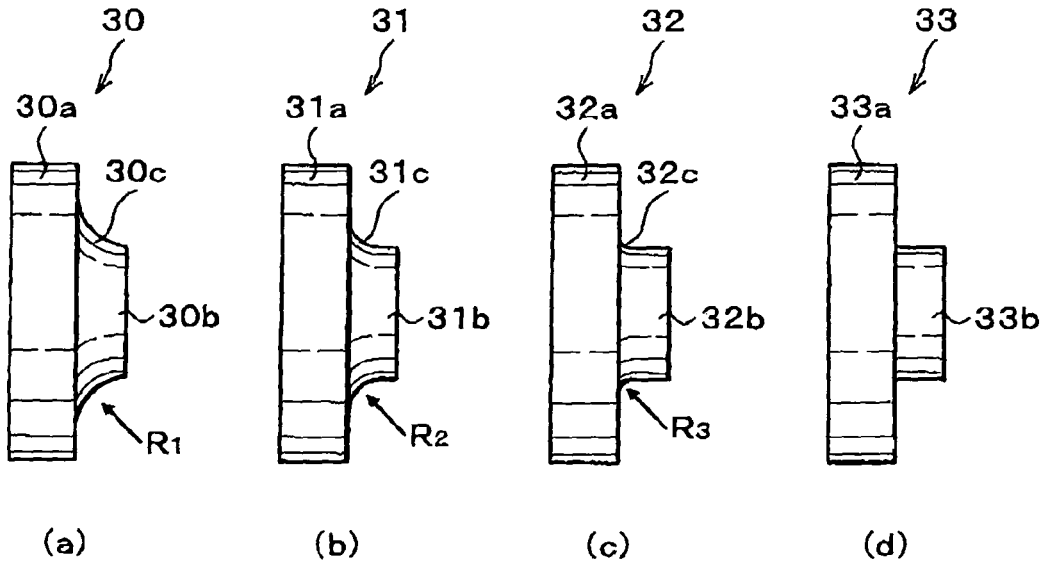
FIG. 12 are side views of rolls according to other embodiments, wherein (a) shows a roll having a curved part of a radius of curvature of R1, (b) shows a roll having a curved part of a radius of curvature of R2, (c) shows a roll having a curved part of a radius of curvature of R3, and (d) shows a roll not having a curved part.

In the above embodiment, the rolls 30 to 33 had the same shapes, but as shown in FIG. 12(*a*) to (d), these rolls 30 to 33 may also be made different shapes. In this case, as shown in FIG. 12(*a*), at the roll 30, the corner part of the main roll part 30*a* and the projecting roll part 30*b*, that is, the corner part which is formed by the surface of the main roll part 30*a* and the outer circumferential surface of the projecting roll part 30*b*, is formed over the entire outer circumferential surface with a curved part 30*c* which is curved projecting to the inside in a side view. The curved part 30*c* has a radius of curvature R1. In the rolls 31 and 32 of FIGS. 12(*b*) and (*c*) as well, similarly, curved parts 31*c* and 32*c* are respectively formed. The curved parts 31*c* and 32*c* respectively have the radii of curvature R2 and R3. The radii of curvature R1 to R3 of the curved parts 30*c* to 32*c* are different radii of curvature where R1>R2>R3. On the other hand, as shown in FIG. 12(*d*), the roll 33 is not formed with the above-mentioned curved part.

Further, when using the above rolls 30 to 33 to shape the sheet metal H, first, the rolls 33 having the curved part 30*c* with the large radius of curvature are used to shape the sheet metal H. Next, the rolls 31 and 32 are successively used to shape the sheet metal H. Finally, the rolls 33 not having a curved part are used to form the sheet metal H into a predetermined shape. In this way, it is possible to shape the sheet metal H in stages so as to efficiently form the sheet metal H into a predetermined shape.

Note that, to shape the sheet metal H in stages in the above way, it is also possible to successively reduce the diameters of the projecting roll parts 30*b* to 33*b* of the rolls 30 to 33.

Figure 13:
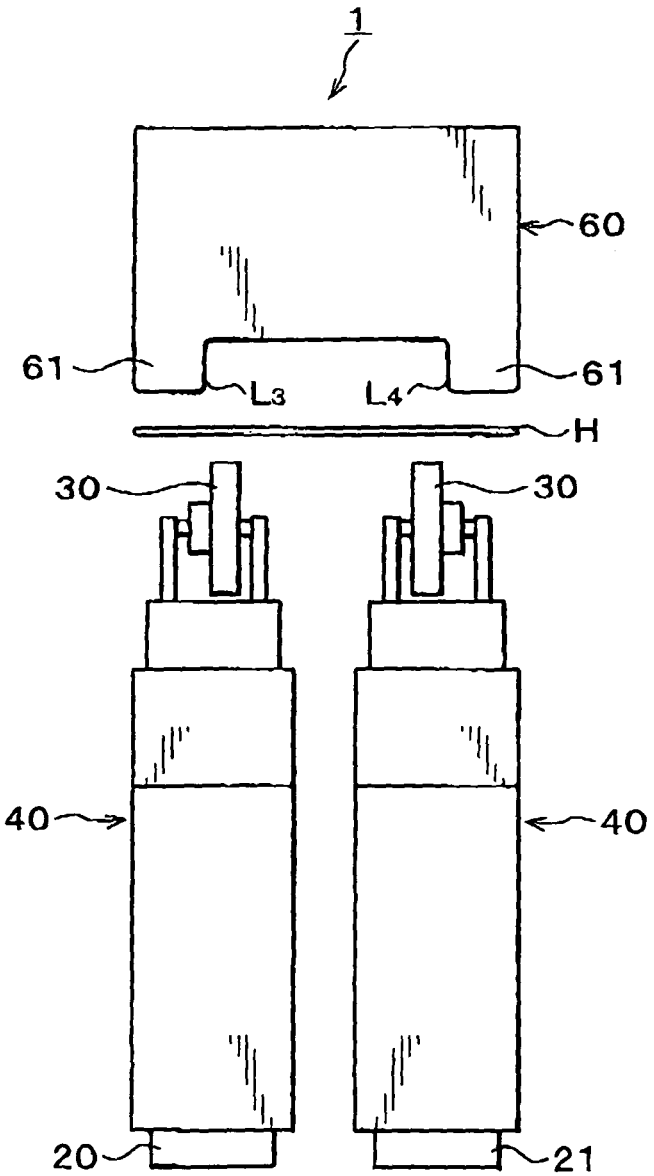
FIG. 13 is a side view showing an outline of the configuration of a working apparatus according to another embodiment.

In the above embodiment, a die 10 with a projecting part 11 formed at the inside of the bottom surface was used, but, as shown in FIG. 13, a die 60 with a bottom surface projecting out more at the outer sides than the inside may also be used.

The projecting parts 61 of the die 60 are formed at the two outer sides at the bottom surface of the die 60. In this case, the rails 20 and 21 are laid along ridge lines L3 and L4 of the projecting parts 61. Further, the rolls 30 are made to match with the shapes of the projecting parts 61 by having the main roll parts 30*a* be arranged at the inside of the projecting part 61 and having the projecting roll parts 30*b* be arranged below the projecting parts 61. That is, the rolls 30 are arranged on the rails 20 and 21 so that the projecting roll parts 30*b* project out to the outer sides. Note that, the rolls 31 to 33 may be similarly arranged on the rails 20 and 21.

In the above embodiment, for the cylinders 43, hydraulic cylinders were used, but the invention is not limited to this so long as it is possible to control the ascent/descent of the rolls 30 to 33 in the vertical direction. For example, for the cylinders 43, electric powered cylinders or pneumatic cylinders etc. may be used. Further, for example, when the vertical load of the rolls 30 to 33 is constant, springs may be used for the cylinders 43.

Further, in the above embodiments, the drive mechanisms 44 had motors (not shown) etc. built into them, but the motors may also be provided outside of the drive mechanisms 44 to make the rolls 30 to 33 move in the horizontal direction. Furthermore, the drive mechanisms 44 of the rolls 30 to 33 may, for example, be connected by wires and the drive mechanisms 44 used to make the rolls 30 to 33 move in the horizontal direction.

EXAMPLES

Below, the formability of sheet metal when using the working apparatus of the present invention will be explained in comparison with the case of using a conventional working apparatus. In the examples, as the working apparatus for the sheet metal, the working apparatus 1 shown in FIG. 1 to FIG. 4 was used. Further, as a conventional working apparatus, a 2000 kN press was used.

Further, these working apparatuses were used to form the three types of steel sheets having the mechanical properties shown in Table 1, that is, soft steel sheet (Test Material No. 1), 780 MPa HSS steel sheet (Test Material No. 2), 980 MPa HSS steel sheet (Test Material No. 3), and 1470 MPa steel sheet (Test Material No. 4), respectively to the shape shown in FIG. 5. Note that, the blank holder load when working the steel sheet was 400 kN, while the back pressure load was 170 kN. Further, as the lubrication condition when working the steel sheet, an anti-corrosion oil was used.

The inventors ran experiments under the above conditions. As a result, when using the conventional working apparatus, the steel sheet of Test Material No. 1 had a good formability, but with the steel sheet of Test Material No. 2, wrinkles were formed at the compressed flange part (compressed flange part B in FIG. 5). Further, in the steel sheets of the Test Material Nos. 3 and 4, wrinkles were formed at the compressed flange part (compressed flange part B in FIG. 5) and cracks were formed at the elongated flange part (elongated flange part A in FIG. 5).

As opposed to this, when using the working apparatus of the present invention, it was possible to work the steel sheets of all of the Test Material No. 1 to No. 4 well. Therefore, it was learned that when using the working apparatus of the present invention, it is possible to work high strength steel sheet into complicated shapes with a good precision.

TABLE 1

| Test Material No. | Steel sheet | Sheet thickness (mm) | Yield stress (MPa) | Tensile strength (MPa) | Elongation (%) | n-value |
|---|---|---|---|---|---|---|
| 1 | Soft steel | 1.2 | 149 | 293 | 49 | 0.268 |
| 2 | 780 MPa HSS | 1.2 | 472 | 811 | 28 | 0.235 |
| 3 | 980 MPa HSS | 1.2 | 579 | 990 | 18 | 0.124 |
| 4 | 1470 MPa HSS | 1.2 | 1350 | 1495 | 8 | 0.08 |

Figure 14:
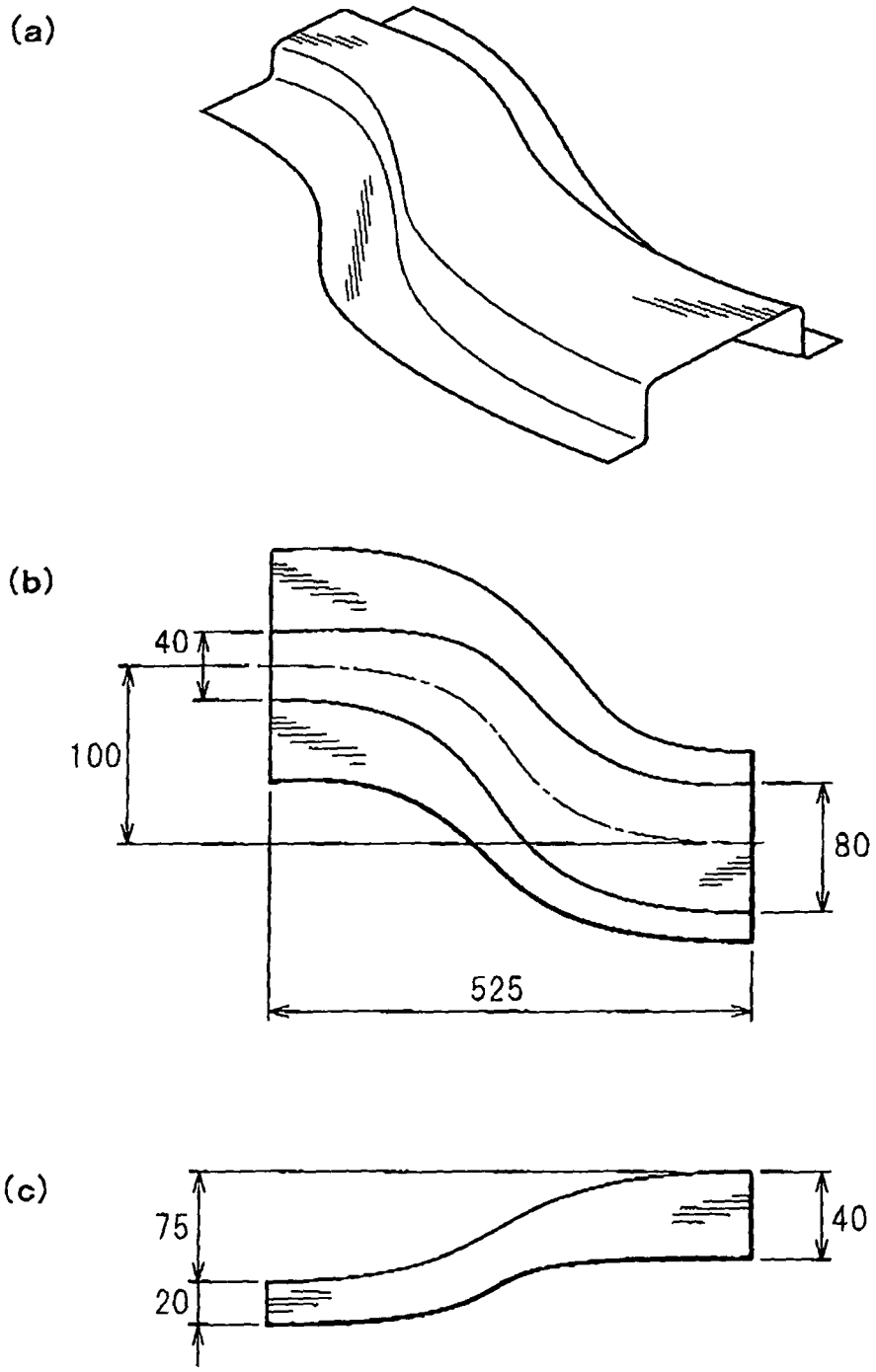
FIG. 14 give views of sheet metal formed into a complicated shape, wherein (a) is a perspective view, (b) is a plan view, and (c) is a side view.

Further, each of the steel sheets of Test Material Nos. 3 and 4 of Table 1 was worked so as to give a product as shown in FIG. 14 with a cross-sectional shape of a substantially rectangular groove shape in the same way as FIG. 7, so that the product was curved 100 mm in the horizontal direction and 75 in the vertical direction with respect to the sheet metal longitudinal direction in the same way as in FIGS. 5 and 6, and, furthermore, so that the peak height (D in FIG. 7) changed from 30 mm at one end to 40 mm at the other end in the sheet metal longitudinal direction. Even when working the sheets to such complicated shapes, no wrinkling or cracking occurred.

Industrial Applicability

The present invention is useful when working sheet metal into a three-dimensionally complicated shape.

Reference Signs List

| | |
|---|---|
| 1 | working apparatus |
| 10 | die |
| 11 | projecting part |
| 20, 21 | rail |
| 30 to 33 | roll |
| 30a to 33a | main roll part |
| 30b to 33b | projecting roll part |
| 30c to 33c | curved part |
| 40 | roll movement mechanism |
| 41 | shaft |
| 42 | support member |
| 43 | cylinder |
| 44 | drive mechanism |
| 50 | control unit |
| 60 | die |
| 61 | projecting part |
| A | elongated flange part |
| B | compressed flange part |
| H | sheet metal |
| H1 | projecting part |
| L1 to L4 | ridge line |
| R1 to R3 | radius of curvature |

The invention claimed is:

1. A working apparatus for shaping sheet metal comprising:

a die having a shape corresponding to a shape desired for shaped sheet metal, the shape including a projecting part having ridge lines, a plurality of rolls configured to grip sheet metal between the rolls and the die to shape the sheet metal, and roll movement mechanisms configured to independently move the rolls horizontally and vertically, wherein each of the plurality of rolls has a main roll part and a projecting roll part, the projecting roll part concentrically projecting out from the main roll part and having a smaller diameter than the main roll part, and wherein the roll movement mechanisms independently move along the ridge lines of the die so that the main roll part is disposed outside of the projecting part and the projecting roll part faces the projecting part.

2. The working apparatus for shaping sheet metal as set forth in claim 1, further comprising a roll angle setting mechanism configured to set the roll movement mechanisms at an angle for pressing the rolls against the sheet metal between the rolls and the die.

3. The working apparatus for shaping sheet metal as set forth in claim 1, further comprising working load detection devices configured to detect working loads on the movement mechanisms.

4. A working apparatus for shaping sheet metal comprising:

a die having a shape corresponding to a shape desired for shaped sheet metal, the shape including a projecting part having ridge lines, a plurality of rolls configured to grip sheet metal between the rolls and the die to shape the sheet metal, and roll movement mechanisms configured to independently move the rolls horizontally and vertically, wherein each of the plurality of rolls has a main roll part and a projecting roll part, the projecting roll part concentrically projecting out from the main roll part and having a smaller diameter than the main roll part, and wherein the roll movement mechanisms independently move along the ridge lines of the die so that the main roll part is disposed outside of the projecting part and the projecting roll part faces the projecting part, wherein an outer circumferential surface of the projecting roll part is curved, and the plurality of rolls have projecting roll parts having curves with different radii of curvature.

5. A working apparatus for shaping sheet metal comprising:

a die having a shape corresponding to a shape desired for shaped sheet metal, the shape including a projecting part having ridge lines, a plurality of rolls configured to grip sheet metal between the rolls and the die to shape the sheet metal, and roll movement mechanisms configured to independently move the rolls horizontally and vertically, wherein each of the plurality of rolls has a main roll part and a projecting roll part, the projecting roll part concentrically projecting out from the main roll part and having a smaller diameter than the main roll part, and wherein the roll movement mechanisms independently move along the ridge lines of the die so that the main roll part is disposed outside of the projecting part and the projecting roll part faces the projecting part, wherein the plurality of rolls have projecting roll parts having different diameters.

6. A working apparatus for shaping sheet metal comprising:

a die having a shape corresponding to a shape desired for shaped sheet metal, the shape including a projecting part having ridge lines, a plurality of rolls configured to grip sheet metal between the rolls and the die to shape the sheet metal, and roll movement mechanisms configured to independently move the rolls horizontally and vertically, wherein each of the plurality of rolls has a main roll part and a projecting roll part, the projecting roll part concentrically projecting out from the main roll part and having a smaller diameter than the main roll part, and wherein the roll movement mechanisms independently move along the ridge lines of the die so that the main roll part is disposed outside of the projecting part and the projecting roll part faces the projecting part, wherein the die has a planar shape with an inside which projects out further than outer sides of the die, and the projecting roll parts project out from the inner sides of the main roll parts.

7. A working apparatus for shaping sheet metal comprising:

a die having a shape corresponding to a shape desired for shaped sheet metal, the shape including a projecting part having ridge lines, a plurality of rolls configured to grip sheet metal between the rolls and the die to shape the sheet metal, and roll movement mechanisms configured to independently move the rolls horizontally and vertically, wherein each of the plurality of rolls has a main roll part and a projecting roll part, the projecting roll part concentrically projecting out from the main roll part and having a smaller diameter than the main roll part, and wherein the roll movement mechanisms independently move along the ridge lines of the die so that the main roll part is disposed outside of the projecting part and the projecting roll part faces the projecting part, wherein the die has a planar shape with outer sides which project out further than an inside portion of the die, and the projecting roll parts project out from the outer sides of the main roll parts.

8. A method for working sheet metal, the method comprising:

independently vertically raising a plurality of rolls, gripping sheet metal between the rolls and a die at a predetermined load, wherein the die has a shape suitable for a shape desired for shaping the sheet metal, the shape including a projecting part having ridge lines, wherein each of the plurality of rolls has a main roll part and a projecting roll part, the projecting roll part concentrically projecting out from the main roll part and having a smaller diameter than the main roll part, and independently moving the rolls horizontally along the ridge lines of the die so that that the main roll part of each roll of the plurality of rolls is disposed outside of the projecting part and the projecting roll part of each roll of the plurality of rolls faces the projecting part, shaping the sheet metal.

9. A method for working sheet metal, the method comprising:

independently vertically raising a plurality of rolls, gripping sheet metal between the rolls and a die at a predetermined load, wherein the die has a shape suitable for a shape desired for shaping the sheet metal, the shape including a projecting part having ridge lines, wherein each of the plurality of rolls has a main roll part and a projecting roll part, the projecting roll part concentrically projecting out from the main roll part and having a smaller diameter than the main roll part, and independently moving the rolls horizontally along the ridge lines of the die so that that the main roll part of each roll of the plurality of rolls is disposed outside of the projecting part and the projecting roll part of each roll of the plurality of rolls faces the projecting part, shaping the sheet metal, wherein each of the rolls has a curved part which is provided over an entirety of an outer circumferential surface of a corner part of the main roll part and the projecting roll part and which is curved to project to an inside in a side view, the plurality of rolls having different radius of curvatures of the curved parts is used for shaping the sheet metal.

10. A method for working sheet metal, the method comprising:

independently vertically raising a plurality of rolls, gripping sheet metal between the rolls and a die at a predetermined load, wherein the die has a shape suitable for a shape desired for shaping the sheet metal, the shape including a projecting part having ridge lines, wherein each of the plurality of rolls has a main roll part and a projecting roll part, the projecting roll part concentrically projecting out from the main roll part and having a smaller diameter than the main roll part, and independently moving the rolls horizontally along the ridge lines of the die so that that the main roll part of each roll of the plurality of rolls is disposed outside of the projecting part and the projecting roll part of each roll of the plurality of rolls faces the projecting part, shaping the sheet metal, wherein the projecting roll parts of the plurality of rolls have different diameters.

11. The method for working sheet metal as set forth in claim 8, further comprising shaping the sheet metal, forming one or both of an elongated flange part on which a tensile force acts and a compressed flange part on which a compressive force acts.

12. A method for working sheet metal, the method comprising:

independently vertically raising a plurality of rolls, gripping sheet metal between the rolls and a die at a predetermined load, wherein the die has a shape suitable for a shape desired for shaping the sheet metal, the shape including a projecting part having ridge lines, wherein each of the plurality of rolls has a main roll part and a projecting roll part, the projecting roll part concentrically projecting out from the main roll part and having a smaller diameter than the main roll part, independently moving the rolls horizontally along the ridge lines of the die so that that the main roll part of each roll of the plurality of rolls is disposed outside of the projecting part and the projecting roll part of each roll of the plurality of rolls faces the projecting part, shaping the sheet metal, shaping the sheet metal, forming one or both of an elongated flange part on which a tensile force acts and a compressed flange part on which a compressive force acts, and forming an elongated flange part where a tensile force acts on the shaped sheet metal, and moving a pair of the rolls in a direction approaching each other centered about the elongated flange part.

13. A method for working sheet metal, the method comprising:

independently vertically raising a plurality of rolls, gripping sheet metal between the rolls and a die at a predetermined load, wherein the die has a shape suitable for a shape desired for shaping the sheet metal, the shape including a projecting part having ridge lines, wherein each of the plurality of rolls has a main roll part and a projecting roll part, the projecting roll part concentrically projecting out from the main roll part and having a smaller diameter than the main roll part, independently moving the rolls horizontally along the ridge lines of the die so that that the main roll part of each roll of the plurality of rolls is disposed outside of the projecting part and the projecting roll part of each roll of the plurality of rolls faces the projecting part, shaping the sheet metal, shaping the sheet metal, forming one or both of an elongated flange part on which a tensile force acts and a compressed flange part on which a compressive force acts, and forming a compressed flange part where a compressive force acts on the shaped sheet metal, and moving a pair of the rolls in a direction separating the rolls from each other centered about the compressed flange part.

14. The method for working sheet metal as set forth in claim 8, wherein the sheet metal is high strength steel sheet having a tensile strength of 780 MPa or more.

* * * * *